US008469017B2

(12) United States Patent
Berkenkoetter et al.

(10) Patent No.: US 8,469,017 B2
(45) Date of Patent: Jun. 25, 2013

(54) BAKING OVEN WITH A VAPOR CHANNEL IN WHICH A CATALYST AND A GAS SENSOR ARE ARRANGED

(75) Inventors: Herbert Berkenkoetter, Oelde (DE); Ulrich Sillmen, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 1420 days.

(21) Appl. No.: 11/719,874

(22) PCT Filed: Nov. 4, 2005

(86) PCT No.: PCT/EP2005/011800

§ 371 (c)(1),
(2), (4) Date: May 22, 2007

(87) PCT Pub. No.: WO2006/056305

PCT Pub. Date: Jun. 1, 2006

(65) Prior Publication Data

US 2009/0165770 A1 Jul. 2, 2009

(30) Foreign Application Priority Data

Nov. 25, 2004 (DE) ..... 10 2004 056 839

(51) Int. Cl.
*F24C 15/32* (2006.01)

(52) U.S. Cl.
USPC ..... 126/21 A; 126/21 R; 126/299 R; 126/301

(58) Field of Classification Search
USPC ..... 126/21 A, 21 R, 301, 299 R, 300, 126/302; 219/413
See application file for complete search history.

(56) References Cited

U.S. PATENT DOCUMENTS

| | | | | | |
|---|---|---|---|---|---|
| 4,038,032 | A | * | 7/1977 | Brewer et al. | 436/55 |
| 4,163,894 | A | * | 8/1979 | Scherer | 219/391 |
| 4,328,478 | A | | 5/1982 | Murata et al. | |
| 4,481,404 | A | * | 11/1984 | Thomas et al. | 219/398 |
| 4,547,642 | A | * | 10/1985 | Smith | 219/685 |
| 4,954,694 | A | | 9/1990 | Nagai et al. | |
| 5,140,120 | A | * | 8/1992 | Kasai et al. | 219/710 |
| 5,614,671 | A | * | 3/1997 | Morrissey | 73/335.05 |
| 5,826,520 | A | * | 10/1998 | Mainord | 110/342 |

FOREIGN PATENT DOCUMENTS

| | | |
|---|---|---|
| DE | 3034070 | 3/1981 |
| DE | 4239334 | 5/1994 |
| DE | 4341410 | 6/1995 |
| DE | 19706186 | 8/1998 |
| EP | 0380733 | 8/1990 |
| EP | 0504555 | 9/1992 |
| EP | 0663568 | 7/1995 |
| JP | 56162327 | 12/1981 |
| JP | 57035227 | 2/1982 |
| JP | 01041721 | 2/1989 |

* cited by examiner

*Primary Examiner* — Thomas Denion
*Assistant Examiner* — Daniel Bernstein
(74) *Attorney, Agent, or Firm* — Leydig, Voit & Mayer, Ltd.

(57) ABSTRACT

A baking oven includes a vapor duct configured to convey vapors generated in the baking oven, and a catalyst disposed in the vapor duct so that the vapors pass through the catalyst. A controller is included, and a humidity sensor is disposed downstream of the catalyst and connected in signal communication with the controller. The humidity sensor is a semiconductor gas sensor. The vapor duct is bounded, in a section of the duct between the catalyst and a location downstream of the semiconductor gas sensor, by an airtight duct wall in a direction transverse to a direction of vapor flow in the vapor duct.

6 Claims, 3 Drawing Sheets

BAKING OVEN WITH A VAPOR CHANNEL IN WHICH A CATALYST AND A GAS SENSOR ARE ARRANGED

CROSS REFERENCE TO PRIOR APPLICATION

This is a U.S. national phase application under 35 U.S.C. §371 of International Patent Application No. PCT/EP2005/011800, filed Nov. 4, 2005, and claims benefit of German Patent Application No. 10 2004 056 839.1, filed Nov. 25, 2004, which is incorporated by reference herein. The International Application was published in German on Jun. 1, 2006 as WO 2006/056305 A1 under PCT Article 21(2).

The present invention relates to a baking oven having a vapor duct in which a catalyst is disposed in such a manner that vapors which are generated in the baking oven and removed through the vapor duct must pass through the catalyst, and that a humidity sensor connected in signal communication with a controller of the baking oven is disposed downstream of the catalyst.

BACKGROUND he English language abstract of JP 01041721 A discloses a baking oven having a vapor duct in which a catalyst is disposed in such a manner that vapors which are generated in the baking oven and removed through the vapor duct must pass through the catalyst, and that a humidity sensor connected in signal communication with a controller of the baking oven is disposed downstream of the catalyst. The humidity sensor is used to determine the soil level of the oven chamber of the baking oven. The objective of this is to keep to the absolute minimum the time during which the oven chamber is heated to a temperature of 500° C. for purposes of pyrolytic cleaning.

German Patent Application DE 43 41410A1 describes a baking oven that uses a humidity sensor in the form of a semiconductor gas sensor. However, no specific information is provided on the exact arrangement of the sensor in the vapor duct.

SUMMARY

In view of the above, it is an aspect of the present invention to provide a baking oven in which a humidity sensor in the form of a semiconductor gas sensor can be used for oven control, and in which, at the same time, it is possible to achieve high control accuracy.

In an embodiment, the present invention provides a baking oven including a vapor duct configured to convey vapors generated in the baking oven, and a catalyst disposed in the vapor duct so that the vapors pass through the catalyst. A controller is included, and a humidity sensor is disposed downstream of the catalyst and connected in signal communication with the controller. The humidity sensor includes a semiconductor gas sensor. The vapor duct is bounded, in a section of the duct between the catalyst and a location downstream of the semiconductor gas sensor, by an airtight duct wall in a direction transverse to a direction of vapor flow in the vapor duct.

BRIEF DESCRIPTION OF THE DRAWINGS

Exemplary embodiments of the present invention are shown in the drawings in a purely schematic way and will be described in more detail below. In the drawings.

DETAILED DESCRIPTION

Figure 1:
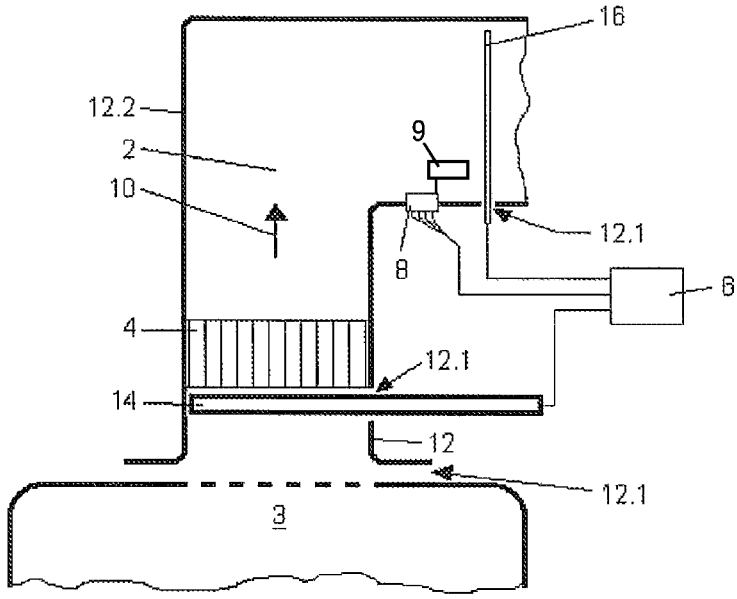
FIG. 1 is a partial cross-sectional view of a first exemplary embodiment of a baking oven according to the present invention.

In addition to the possibility of using a humidity sensor in the form of a semiconductor gas sensor for oven control while at the same time achieving high accuracy in the control of the baking oven, a particular advantage offered by the present invention is that semiconductor gas sensors are inexpensive standard components. Moreover, semiconductor gas sensors are particularly well suited for the operating conditions of a baking oven, in particular for the high temperatures and the vapors generated during any roasting or baking process.

In addition, the use of a semiconductor gas sensor as the humidity sensor always involves the problem that oxidizable gases in very low concentrations cause semiconductor gas sensors to generate an output signal comparable in magnitude to that generated by steam in much higher concentrations. In a baking oven, such oxidizable gases are generated, first of all, by the cooking process and can be oxidized by a catalyst, thereby significantly reducing the unwanted effects on the output signal of the semiconductor gas sensor. Secondly, in conventional baking ovens, oxidizable gases and steam are also introduced into the vapor duct through the vapor duct wall at a position downstream of the catalyst, which also affects the output signal of the semiconductor gas sensor in the manner described above. This is because in conventional baking ovens, the duct wall of the vapor duct has openings for various measuring devices, such as temperature sensors for controlling roasting and baking processes or pyrolysis processes in baking ovens having a pyrolysis function. In addition, the vapor ducts of conventional baking ovens are manufactured from sheet metal blanks, which are folded and joined together with screws or rivets.

The general inventive concept of the baking oven of the present invention is to dispose the semiconductor gas sensor such that the vapors conducted through the vapor duct and coming into contact with the semiconductor gas sensor are forced through a catalyst before they reach the semiconductor gas sensor in order to oxidize the oxidizable gases contained in the vapors. Vapors coming into contact with the semiconductor gas sensor are understood to also include a fresh air/vapor mixture formed by the intermixing of fresh air and vapors. In this process, fresh air enters the vapor duct through openings in the duct wall.

The baking oven according to an embodiment of the present invention has the additional advantage that the number of components is reduced as compared to the two other alternatives.

In another embodiment of the present invention, unlike that mentioned above, additionally uses a sensor channel in which is disposed the semiconductor gas sensor, the there is no need to change the conventional vapor duct design described hereinbefore. Therefore, this alternative is also suitable for retrofitting conventional baking ovens.

Another embodiment of the present invention also features a sensor channel accommodating the semiconductor gas sensor. In this alternative, an additional catalyst is disposed in the sensor channel and upstream of the semiconductor gas sensor. This allows the dimensions of the sensor channel and its arrangement relative to the catalyst to be selected substantially independently of the same.

In an advantageous embodiment of the baking oven according to the present invention, the catalyst has a downstream recess into which fits the portion of the sensor channel where the inlet opening is located. This ensures that the vapors directed through the sensor channel to the semiconductor gas sensor have passed through the catalyst.

In an advantageous refinement of the aforementioned embodiment, the catalyst includes two adjacent disk-shaped catalyst honeycombs, the downstream catalyst honeycomb being in the form of an annular disk and having an opening which corresponds to the outer diameter of the sensor channel in the region where the sensor channel contacts the catalyst. Thus, the aforementioned design approach can be implemented in a particularly simple manner. Moreover, such catalyst honeycombs are inexpensive standard components.

In another advantageous embodiment of the baking oven according to the present invention, the sensor channel, at its end provided with the inlet opening, substantially directly abuts the catalyst. This allows the catalyst to be selected within wide suitable limits in terms of type, material, and dimensions.

According to an advantageous refinement of the aforementioned embodiment, the inlet opening facing the catalyst widens in the shape of a funnel toward the catalyst. Because of this, the flow velocity in the sensor channel is increased, so that the measuring surface of the semiconductor gas sensor disposed therein is cleaned mechanically. This also facilitates the attachment of the sensor channel to the vapor duct or to the remainder of the baking oven of the present invention, because the sensor channel is supported by the catalyst.

In an advantageous refinement of the teaching according to the present invention, the distance between the catalyst, or the additional catalyst, and the semiconductor gas sensor is minimized in such a manner that the maximum permissible temperature of the semiconductor gas sensor is not exceeded during operation of the baking oven. The length of the vapor duct section or sensor channel section that is bounded by an airtight duct wall in a direction transverse to the direction of flow in the vapor duct or sensor channel is thereby reduced to a minimum.

In another advantageous refinement of the teaching according to the present invention, the semiconductor gas sensor, or a heat sink thermally conductively connected to the semiconductor gas sensor, is disposed in the baking oven in such a manner that the semiconductor gas sensor can be cooled by a fan of the baking oven. This allows the semiconductor gas sensor to be cooled in a particularly simple manner.

In an advantageous refinement of the aforementioned embodiment, the fan draws in fresh air from the ambient environment during operation of the baking oven, and the semiconductor gas sensor, or the heat sink, is disposed in the baking oven in such a manner that it is partially in contact with the drawn in air. This allows the semiconductor gas sensor to be cooled in a particularly simple and effective manner.

FIG. 1 shows, in a partial view, a first exemplary embodiment of a baking oven according to the present invention. The baking oven has a vapor duct 2 in which is disposed a catalyst 4. Catalyst 4 is in the form of a so-called catalyst honeycomb. However, alternatively, other forms and types of catalysts can also be used, such as a catalyst made of bulk material. Vapor channel 2 is connected in fluid communication with an oven chamber 3 of the baking oven in a manner known to those skilled in the art. The vapors generated in oven chamber 3 during a roasting or baking process are discharged to the ambient environment through vapor duct 2. In this process, the vapors pass through catalyst 4, and the oxidizable gases contained in the vapors are oxidized. Furthermore, a humidity sensor 8 connected in signal communication with a controller 6 of the baking oven is disposed in vapor duct 2 at a position downstream of catalyst 4 with respect to the vapor duct flow direction. Said humidity sensor 8 is in the form of a semiconductor gas sensor. A heat sink 9 may be thermally conductively connected to the humidity sensor 8. The vapor duct flow direction is symbolized by an arrow 10. Vapor duct 2 is bounded by a duct wall 12 in a direction transverse to vapor duct flow direction 10.

In addition, a catalyst heating element 14 and a temperature sensor 16 protrude into vapor duct 2 through openings 12.1 in duct wall 12. Catalyst heating element 14 and temperature sensor 16 are also connected in signal communication with controller 6 of the baking oven. Catalyst heating element 14 and temperature sensor 16 cooperate with controller 6 in a manner known to those skilled in the art. In this exemplary embodiment, semiconductor gas sensor 8 is made from doped tin oxide. In principle, however, it is also conceivable to use other semiconductor materials, such as doped tungsten oxide or gallium oxide. The present semiconductor gas sensor made of doped tin oxide has a permissible temperature range from about 400° C. to 500° C., which may not be exceeded. Therefore, catalyst 4, which may reach temperatures of up to about 700° C. during operation of the baking oven, is suitably spaced from semiconductor gas sensor 8. The vapors heated by catalyst 4 may cool along the flow path to semiconductor gas sensor 8. The same applies to semiconductor gas sensors 8 made of doped tungsten oxide. When using a semiconductor gas sensor 8 made of gallium oxide, the distance between catalyst 4 and semiconductor gas sensor 8 can correspondingly be smaller because gallium oxide sensors are suited for temperatures up to over 700° C.

In this exemplary embodiment, duct wall 12 is in the form of an airtight duct wall 12.2 in the section between catalyst 4 to a point downstream of semiconductor gas sensor 8. The openings 12.1 required for catalyst heating element 14 and temperature sensor 16 are located outside of the section of airtight duct wall 12.2, so that any vapors generated in oven chamber 3 and removed through vapor duct 2 must pass through catalyst 4. This prevents the output signal of semiconductor gas sensor 8 from being affected in an undesired manner by fresh air entering through openings 12.1 in duct wall 12.

The further exemplary embodiments will be described only to the extent that they differ from the preceding ones.

Figure 2:
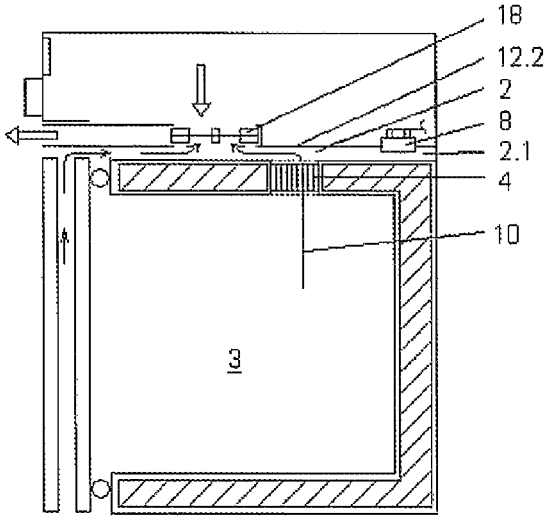
FIG. 2 is a cross-sectional view of a second exemplary embodiment of a baking oven according to the present invention.

FIG. 2 shows a second exemplary embodiment of a baking oven according to the present invention. As explained earlier, vapors generated oven chamber 3 are removed from the baking oven through vapor duct 2. The baking oven of this exemplary embodiment is a baking oven with forced convection. For this purpose, a fan 18 in the form of a radial fan is disposed in the baking oven in a manner known to those skilled in the art, and is in flow communication with vapor duct 2. The main difference from the first exemplary embodiment is that the section of vapor duct 2 that is bounded by an airtight duct wall 12.2 in a direction transverse to vapor duct flow direction 10 has a side section 2.1 in which is disposed semiconductor gas sensor 8. Thus, semiconductor gas sensor 8 is located in a section of vapor duct 2, into which the gases contained in the vapors enter substantially by diffusion. This reduces the extent to which side section 2.1, and thus the region accommodating semiconductor gas sensor 8, is contaminated by the vapors.

Figure 3:
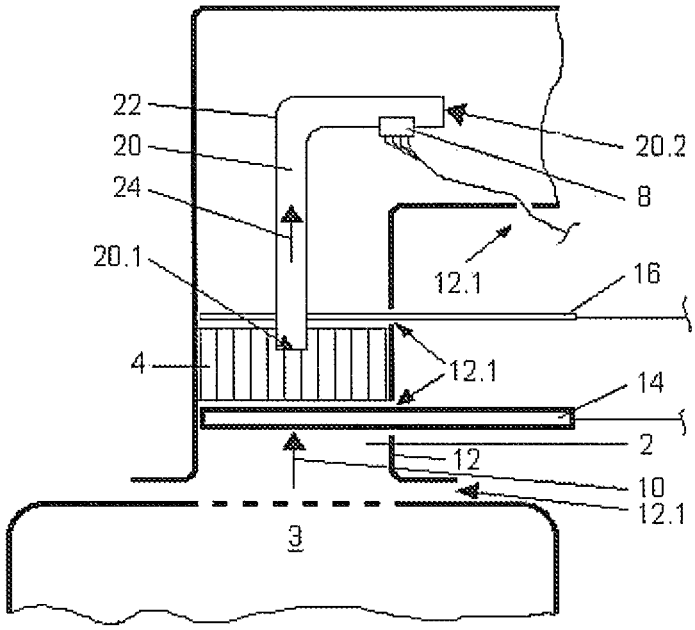
FIG. 3 is a partial cross-sectional view of a third exemplary embodiment of a baking oven according to the present invention.

In FIG. 3, a third exemplary embodiment of a baking oven according to the present invention is shown in a view similar to that in FIG. 1. In this exemplary embodiment, vapor duct 2, and thus also duct wall 12, are designed in a conventional manner. Catalyst heating element 14 and temperature sensor 16 are also conventionally inserted into vapor duct 2 through openings 12.1 in duct wall 12. A sensor channel 20 is disposed approximately centrally in vapor duct 2, said sensor channel being bounded by an airtight channel wall 22 in a direction transverse to the sensor channel flow direction. The sensor channel flow direction is symbolized by an arrow 24. Sensor channel 20 is connected in fluid communication with the remainder of vapor duct 2 via an inlet opening 20.1 and an outlet opening 20.2. In the region of inlet opening 20.1, sensor channel 20 is inserted into a recess of catalyst 4 to ensure that the vapors directed into sensor channel 20 have previously passed through catalyst 4.

Figure 4:
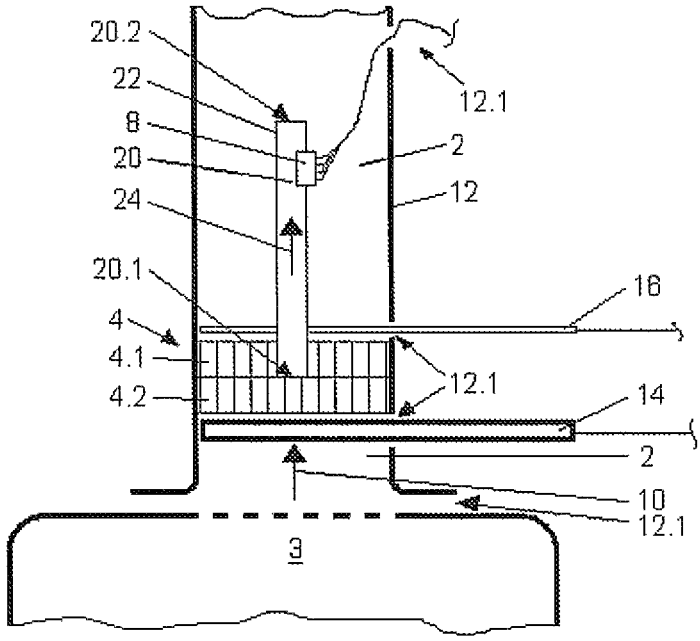
FIG. 4 is a partial cross-sectional view of a fourth exemplary embodiment of a baking oven according to the present invention.

An advantageous refinement of the aforementioned embodiment is shown as a fourth exemplary embodiment in FIG. 4. Here, catalyst 4 includes two adjacent disk-shaped catalyst honeycombs, the downstream catalyst honeycomb 4.1 being in the form of an annular disk and having an opening which corresponds to the outer diameter of sensor channel 20 in the region where the sensor channel contacts catalyst 4. The other catalyst honeycomb 4.2 does not have an opening, so that when the inventive baking oven is in an assembled condition, the resulting arrangement of catalyst 4 and sensor channel 20 is comparable to that of the third exemplary embodiment.

Figure 5:
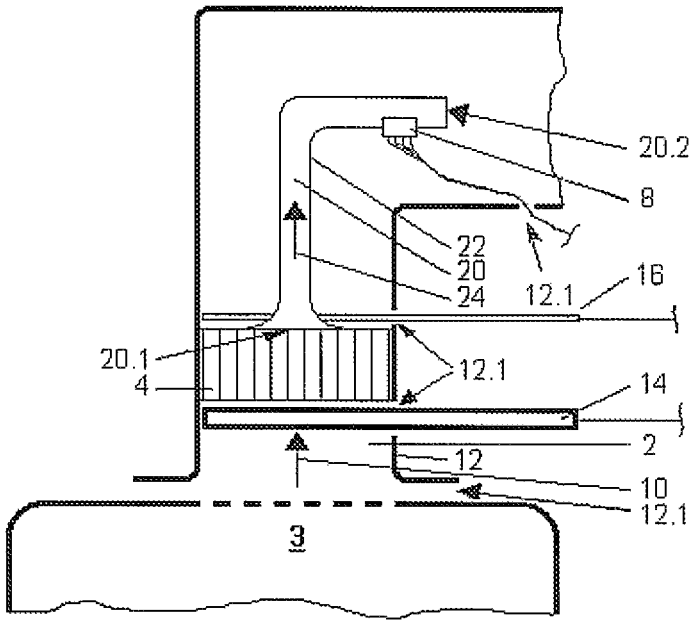
FIG. 5 is a partial cross-sectional view of a fifth exemplary embodiment of a baking oven according to the present invention.

Another alternative is shown as a fifth exemplary embodiment in FIG. 5. Similarly to the two aforementioned exemplary embodiments, sensor channel 20 is disposed approximately at the center of vapor duct 2. Unlike these two exemplary embodiments, sensor channel 20 does not fit into catalyst 4 when the baking oven is in an assembled condition, but bears against the downstream surface of catalyst 4. This embodiment requires the two contact surfaces of catalyst 4 and sensor channel 20 to be machined such that they contact each other in a substantially airtight manner. In principle, however, it is also conceivable for sensor channel 20 not to directly contact catalyst 4, but to be slightly spaced therefrom. In this case, there is no need for a funnel-shaped enlargement of inlet opening 20.1 of sensor channel 20.

Figure 6:
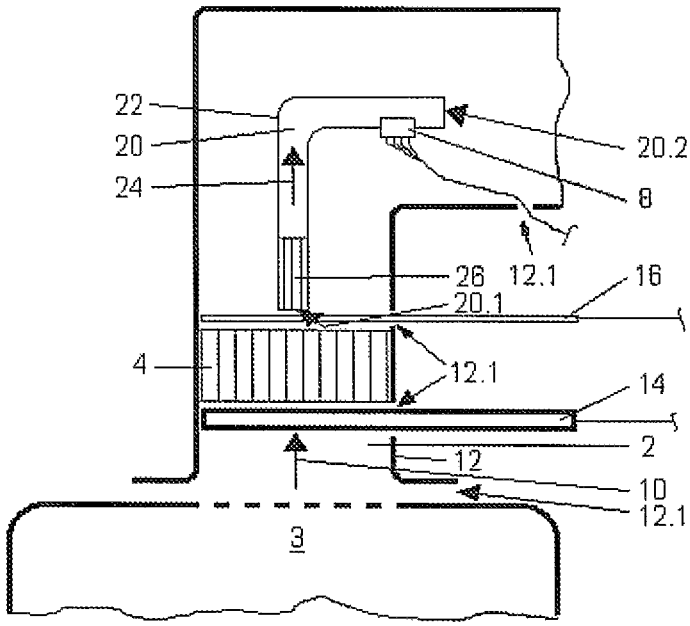
FIG. 6 is a partial cross-sectional view of a sixth exemplary embodiment of a baking oven according to the present invention.

FIG. 6 shows a sixth exemplary embodiment of a baking oven according to the present invention. In this exemplary embodiment, an additional catalyst 26 is disposed in sensor channel 20 in the region of its inlet opening 20.1. This additional catalyst 26 completely fills the free cross-sectional area of sensor channel 20, thus ensuring that the vapors flowing through sensor channel 20 are forced through additional catalyst 26. Alternatively, the free cross-sectional area of sensor channel 20 may be tapered by an adapter (not shown) in the region of additional catalyst 26 in such a manner that it is also possible to use an additional catalyst 26 of smaller cross-sectional area without undesired leakage occurring between channel wall 22 and additional catalyst 26. Additional catalyst 26 is also in the form of a so-called catalyst honeycomb. Analogously to catalyst 4, the additional catalyst 26 can be selected within wide suitable limits in terms of type, material, and dimensions.

In the alternative embodiments, it is advantageous if the distance between catalyst 4, or additional catalyst 26, and semiconductor gas sensor 8 is minimized in such a manner that the permissible temperature range of semiconductor gas sensor 8 is not exceeded during operation of the baking oven.

In the aforementioned exemplary embodiments, semiconductor gas sensor 8 may, in addition, be cooled to further reduce the distance between catalyst 4, or additional catalyst 26, and semiconductor gas sensor 8. The cooling of semiconductor gas sensor 8 may, in principle, be accomplished by many suitable means known to those skilled in the art. Advantageously, semiconductor gas sensor 8, or a heat sink which is thermally conductively connected to semiconductor gas sensor 8, is disposed in the baking oven in such a manner that semiconductor gas sensor 8 can be cooled by a fan of the baking oven, for example by fan 18. Particularly effective cooling can be achieved by the fan drawing in fresh air during operation of the baking oven, and by semiconductor gas sensor 8, or the heat sink, being disposed such that it is partially in contact with the drawn in air.

The present invention is not limited to the embodiments described herein; reference should be had to the appended claims.

What is claimed is:

1. A baking oven comprising:

a vapor duct configured to convey vapors generated in the baking oven;

a catalyst disposed in the vapor duct so that the vapors pass through the catalyst;

a controller; and a humidity sensor disposed downstream of the catalyst and connected in signal communication with the controller, the humidity sensor including a semiconductor gas sensor;

wherein the vapor duct includes:

a section that extends from the catalyst to a location downstream of the semiconductor gas sensor that is bounded by an airtight duct wall in a direction transverse to a direction of vapor flow in the vapor duct, and at least one opening in a wall of the vapor duct for at least one of a heating element or an additional sensor, the at least one opening being disposed outside of the section bounded by the airtight duct wall.

2. The baking oven as recited in claim 1 wherein the semiconductor gas sensor is disposed at a distance from the catalyst so that a maximum permissible temperature of the semiconductor gas sensor is not exceeded during operation of the baking oven.

3. The baking oven as recited in claim 1 further comprising a fan, and wherein the semiconductor gas sensor is disposed in the baking oven so as to be cooled by the fan.

4. The baking oven as recited in claim 3 wherein the fan is configured to draw in fresh air from the ambient environment during operation of the baking oven, and the semiconductor gas sensor is disposed in the baking oven so as to be partially in contact with the drawn in air.

5. The baking oven as recited in claim 1 further comprising a fan and further comprising a heat sink thermally conductively connected to the semiconductor gas sensor, the heat sink being disposed in the baking oven so as to be cooled by the fan.

6. The baking oven as recited in claim 5 wherein the fan is configured to draw in fresh air from the ambient environment during operation of the baking oven, and the heat sink is disposed in the baking oven so as to be partially in contact with the drawn in air.

* * * * *